US011841132B1

(12) United States Patent
Bonucci

(10) Patent No.: US 11,841,132 B1
(45) Date of Patent: Dec. 12, 2023

(54) LED ASSEMBLY HAVING HERMAPHRODITIC ELECTRICAL CONNECTORS

(71) Applicant: TE CONNECTIVITY BRASIL INDUSTRIA DE ELECTRONICOS LTDA, Braganca Paulista (BR)

(72) Inventor: Gustavo Bonucci, Sao Paulo (BR)

(73) Assignee: TE Connectivity Brasil Industria De Eletronicos LTDA

( * ) Notice: Subject to any disclaimer, the term of this patent is extended or adjusted under 35 U.S.C. 154(b) by 0 days.

(21) Appl. No.: 18/179,473

(22) Filed: Mar. 7, 2023

(51) Int. Cl.
*F21V 23/06* (2006.01)
*F21K 9/237* (2016.01)
*F21S 4/28* (2016.01)
*F21Y 115/10* (2016.01)

(52) U.S. Cl.
CPC ..... *F21V 23/06* (2013.01); *F21K 9/237* (2016.08); *F21S 4/28* (2016.01); *F21Y 2115/10* (2016.08)

(58) Field of Classification Search
CPC .. F21V 23/06; F21K 9/237; F21S 4/28; F21Y 2115/10
See application file for complete search history.

(56) References Cited

U.S. PATENT DOCUMENTS 9,614,334 B2 * 4/2017 Chen ..... H01R 43/20
2011/0294351 A1 * 12/2011 Zhu ..... H01R 13/112 439/638
2013/0149908 A1 * 6/2013 Little ..... H01R 12/716 439/660
2015/0311610 A1 * 10/2015 Little ..... H01R 12/707 439/284
2016/0013570 A1 * 1/2016 Fry, Jr. ..... H01R 12/737 29/842
2020/0412073 A1 * 12/2020 Daily ..... H01R 43/26

* cited by examiner

*Primary Examiner* — Evan P Dzierzynski

(57) ABSTRACT

An LED assembly includes electrical connectors mounted to an LED board each having a connector housing having contact channels holding plug contacts and receptacle contacts arranged in the connector housing to form a hermaphroditic mating interface. The plug contacts have male mating ends configured to be plugged into female mating ends of receptacle contacts of a mating LED assembly. The receptacle contacts have female mating ends configured to receive male mating ends of plug contacts of the mating LED assembly.

20 Claims, 7 Drawing Sheets

LED ASSEMBLY HAVING HERMAPHRODITIC ELECTRICAL CONNECTORS

BACKGROUND OF THE INVENTION

The subject matter herein relates generally to lighting systems.

Some known lighting systems include LED assemblies to provide lighting. The LED assemblies have LED elements that are arranged on LED boards. Some known LED boards form long strips of LED elements. However, different applications require different length LED strips. Providing many different LED boards having different lengths requires a large inventory, which may be expensive to maintain. Other lighting systems use smaller LED boards that can be ganged together in a longer strip. However, supplying power to each of the LED boards can be difficult increases cost of the system. Additionally, having different types of connectors increases the cost of the system including the design and manufacturing cost of designing and manufacturing the various types of connectors.

A need remains for a cost effective and reliable method of connecting LED boards in a lighting system.

BRIEF DESCRIPTION OF THE INVENTION

In one embodiment,

In one embodiment, an LED assembly is provided and includes an LED board extending between a first end and a second end. The LED board has an LED element on the LED board. The LED board includes contact pads. The LED assembly includes electrical connectors mounted to the LED board at the first and second ends. Each electrical connector includes a connector housing having a bottom mounted to the LED board and a top opposite the bottom. The connector housing has a front and a rear opposite the front. The connector housing has a first side and a second side. The connector housing has a plurality of contact channels arranged between the first side and the second side. Each electrical connector includes plug contacts arranged in corresponding contact channels. The plug contacts have male mating ends and plug terminating ends terminated to the corresponding mating pads of the LED board. The male mating ends configured to be plugged into female mating ends of receptacle contacts of a mating LED assembly. Each electrical connector includes receptacle contacts arranged in corresponding contact channels. The receptacle contacts have female mating ends and receptacle terminating ends terminated to the corresponding mating pads of the LED board. The female mating ends configured to receive male mating ends of plug contacts of the mating LED assembly. The plug contacts and the receptacle contacts are arranged in the connector housing to form a hermaphroditic mating interface.

In another embodiment, a lighting system is provided and includes a plurality of LED assemblies electrically connected in series. Each LED assembly includes an LED board extending between a first end and a second end. The LED board has an LED element on the LED board. The LED board includes contact pads. Each LED assembly includes electrical connectors mounted to the LED board at the first and second ends. Each electrical connector includes a connector housing having a bottom mounted to the LED board and a top opposite the bottom. The connector housing has a front and a rear opposite the front. The connector housing has a first side and a second side. The connector housing has a plurality of contact channels arranged between the first side and the second side. Each LED assembly includes plug contacts arranged in corresponding contact channels. The plug contacts have a male mating end and a plug terminating end. The plug terminating end is terminated to the corresponding mating pad of the LED board. Each LED assembly includes receptacle contacts arranged in corresponding contact channels. The receptacle contacts have a female mating end and a receptacle terminating end. The receptacle terminating end is terminated to the corresponding mating pad of the LED board. The plug contacts and the receptacle contacts are arranged in the connector housing to form a hermaphroditic mating interface. Adjacent LED assemblies are electrically connected by plugging the male mating ends of the plug contacts into the female mating ends of the receptacle contacts of the corresponding electrical connectors.

In a further embodiment, a lighting system is provided and includes a first LED assembly and a second LED assembly connected in series. The first LED assembly includes a first LED board having a first LED element on the first LED board and a first electrical connector mounted to the first LED board at an end of the first LED board. The first electrical connector includes a first connector housing having a bottom mounted to the first LED board and a top opposite the bottom. The first connector housing has a front and a rear opposite the front. The first connector housing has opposite sides. The first connector housing has first contact channels arranged between the sides. The first electrical connector includes first plug contacts arranged in corresponding first contact channels. The first plug contacts have male mating ends and plug terminating ends terminated to the first LED board. The first electrical connector includes first receptacle contacts arranged in corresponding first contact channels. The first receptacle contacts have female mating ends and receptacle terminating ends terminated to the first LED board. The second LED assembly includes a second LED board having a second LED element on the second LED board and a second electrical connector mounted to the second LED board at an end of the second LED board. The second electrical connector includes a second connector housing has a bottom mounted to the second LED board and a top opposite the bottom. The second connector housing has a front and a rear opposite the front. The second connector housing has opposite sides. The second connector housing has second contact channels arranged between the sides. The second electrical connector includes second plug contacts arranged in corresponding second contact channels. The second plug contacts have male mating ends and plug terminating ends terminated to the second LED board. The second electrical connector includes second receptacle contacts arranged in corresponding second contact channels. The second receptacle contacts have female mating ends and receptacle terminating ends terminated to the second LED board. The first electrical connector is mated to the second electrical connector to electrically connect the first LED board to the second LED board. The first plug contacts being plugged into the second receptacle contacts. The second plug contacts are plugged into the first receptacle contacts.

DETAILED DESCRIPTION OF THE INVENTION

Figure 1:
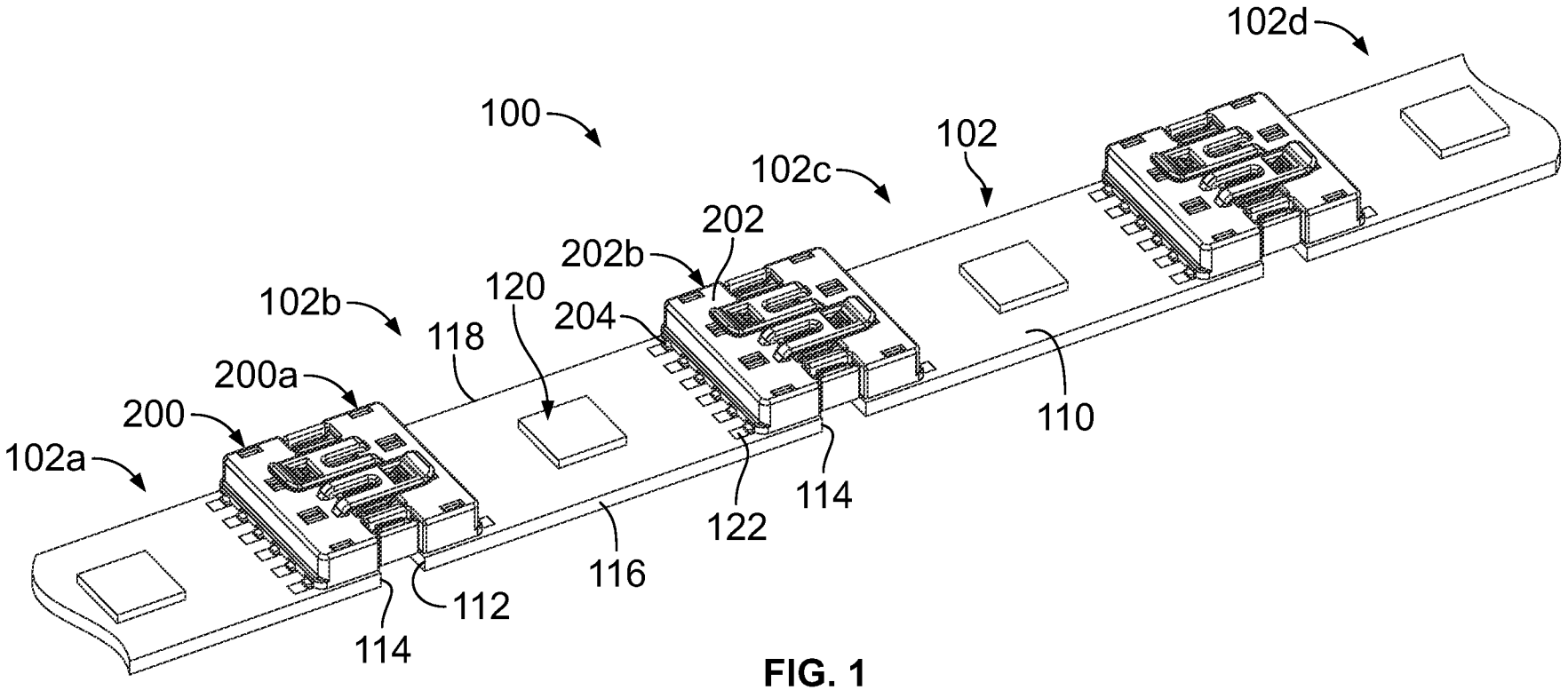
FIG. 1 is a perspective view of a lighting system in accordance with an exemplary embodiment showing a plurality of LED assemblies electrically connected in series.
Figure 2:
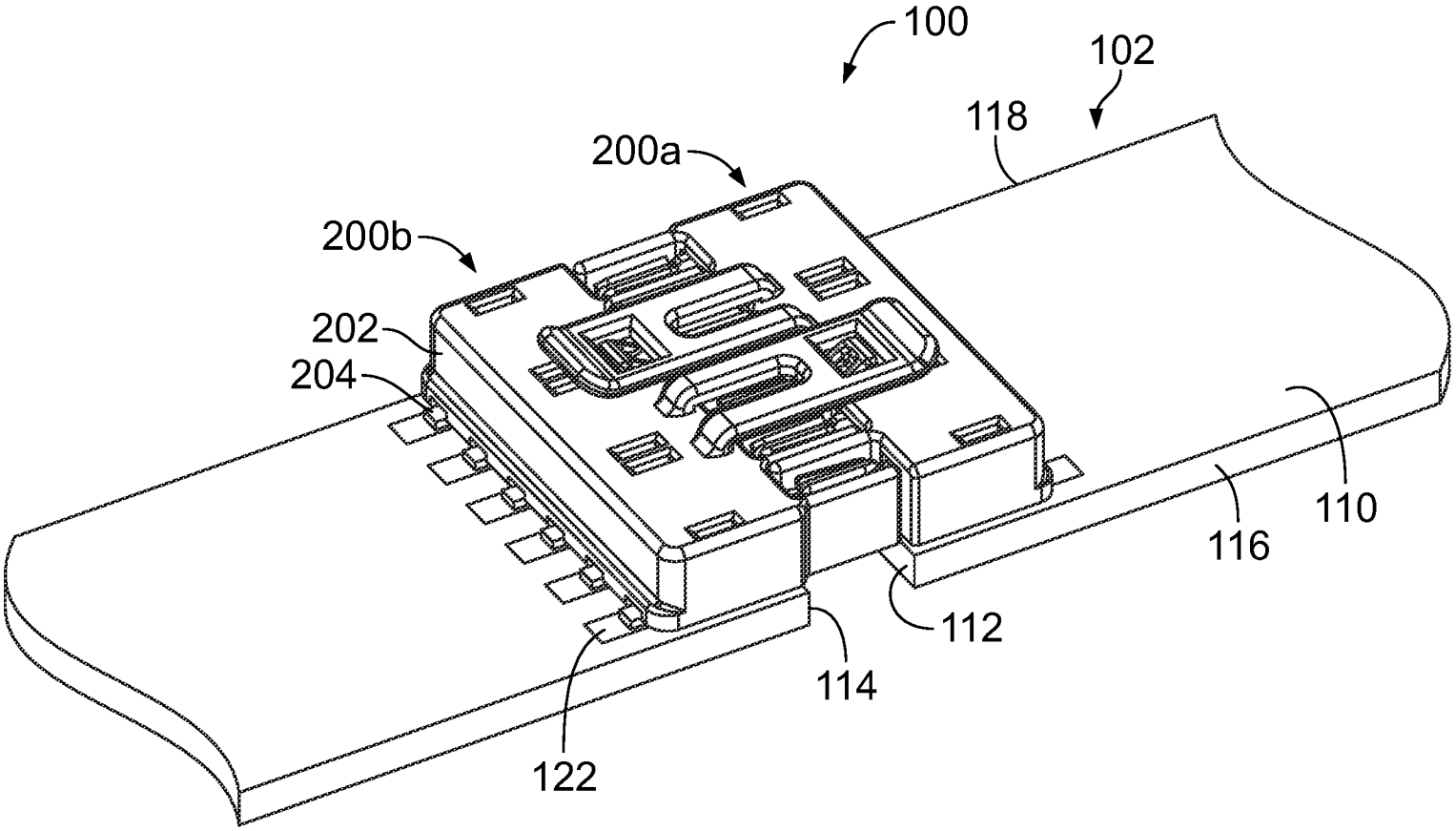
FIG. 2 illustrates a portion of the lighting system showing two of the LED assemblies coupled together in accordance with an exemplary embodiment.

FIG. 1 is a perspective view of a lighting system 100 in accordance with an exemplary embodiment showing a plurality of LED assemblies 102 electrically connected in series. FIG. 2 illustrates a portion of the lighting system showing two of the LED assemblies 102 coupled together in accordance with an exemplary embodiment. The LED assemblies 102 are ganged together to provide power from an upstream LED assembly 102 downstream to the other LED assemblies 102. The LED assemblies 102 are easily and quickly connected together. The electrical connections between the LED assemblies 102 are safe, such as to prevent inadvertent touching or damage to the components of the LED assemblies 102. The lighting system 100 is designed to transfer power from LED assembly 102 to LED assembly 102 in an efficient manner.

In the illustrated embodiment of FIG. 1, the LED assemblies 102 include a first LED assembly 102*a*, a second LED assembly 102*b*, a third LED assembly 102*c*, and a fourth LED assembly 102*d*. The second LED assembly 102*b* is located between the first and third LED assemblies 102*a*, 102*c*. The third LED assembly 102*c* is located between the second and fourth LED assemblies 102*b*, 102*d*. Additionally LED assemblies 102 may be provided upstream of the first LED assembly 102*a* and/or downstream of the fourth LED assembly 102*d*. Greater or fewer LED assemblies 102 may be provided in alternative embodiments. Optionally, the LED assemblies 102 are identical to each other including the same components.

Each LED assembly 102 includes an LED board 110 and electrical connectors 200 mounted to the LED board 110. For example, a first electrical connector 200*a* may be provided at a first end of the LED board 110 and a second electrical connector 200*b* may be provided at a second end of the LED board 110. The electrical connectors 200*a*, 200*b* may be identical to each other and face in opposite directions. The first electrical connector 200*a* is coupled to the second electrical connector 200*b* of the adjacent or upstream LED assembly 102 to transfer power from the upstream LED assembly 102 to the downstream LED assembly 102. In an exemplary embodiment, the LED boards 110 are arranged end to end in a strip. The electrical connectors 200 are mated across the threshold between the corresponding LED boards 110.

Each LED board 110 extends between a front end 112 and a rear end 114. The LED board 110 has sides 116, 118 between the front and rear ends 112, 114. Each LED board 110 includes one or more LED elements 120 on the surface of the LED board 110. The LED board 110 may include a driver or other component for controlling the LED element 120. In the illustrated embodiment, the LED element 120 is provided on the same side (for example, upper surface) of the LED board 110 as the electrical connectors 200. However, in alternative embodiments, the LED element 120 may additionally or alternatively be provided on the opposite sides of the LED board 110 from the electrical connectors 200.

The electrical connectors 200 are mounted to the LED board 110, such as at the ends 112, 114 of the LED board 110. In an exemplary embodiment, each electrical connector 200 includes a connector housing 202 holding a plurality of contacts 204. In various embodiments, the contacts 204 are surface mounted to the LED board 110. For example, the contacts 204 may be soldered to contact pads 122 on the LED board 110. In alternative embodiments, the contacts 204 may be press-fit into plated vias of the LED board 110. In various embodiments, the connector housing 202 is press-fit onto the LED board 110. However, in alternative embodiments, the connector housing 202 may be secured to the LED board 110 using solder tabs, clips, fasteners, or other securing means.

Figure 3:
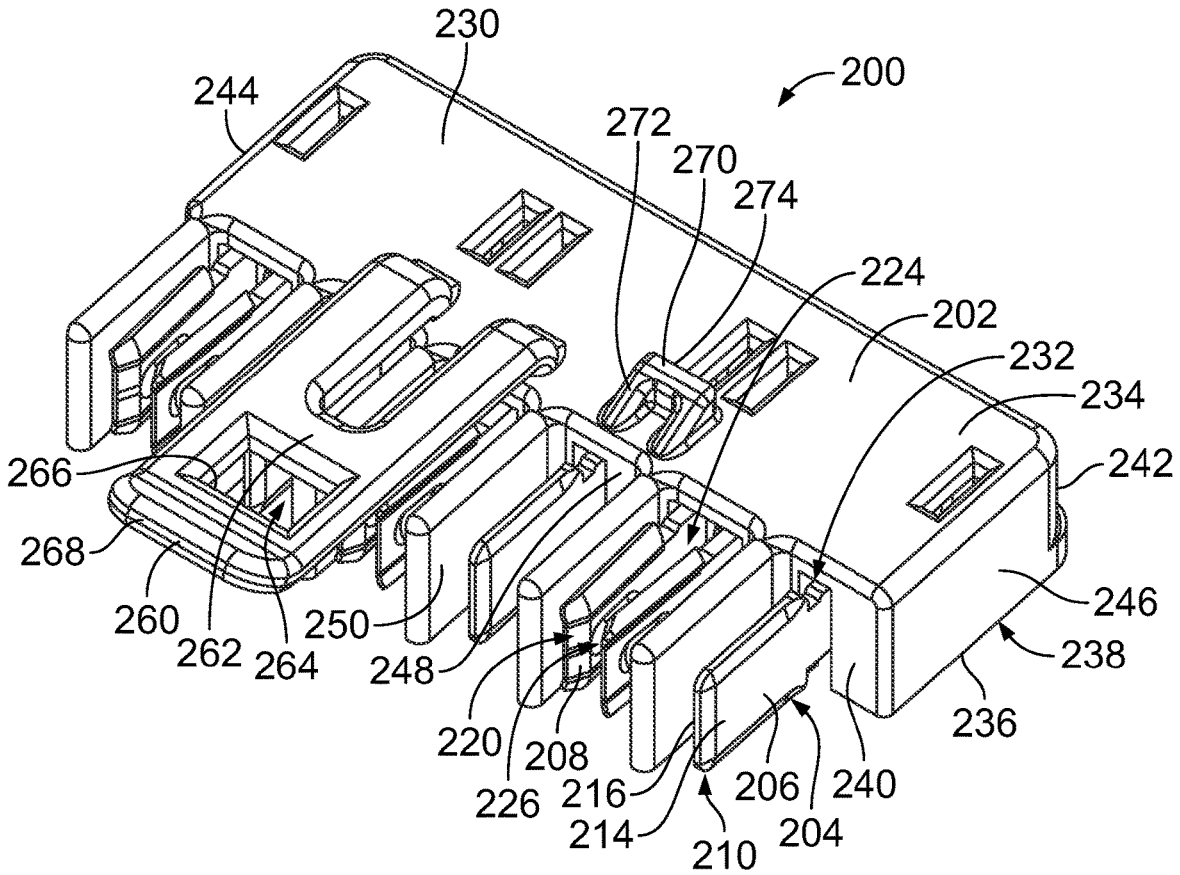
FIG. 3 is a top perspective view of the electrical connector in accordance with an exemplary embodiment.
Figure 4:
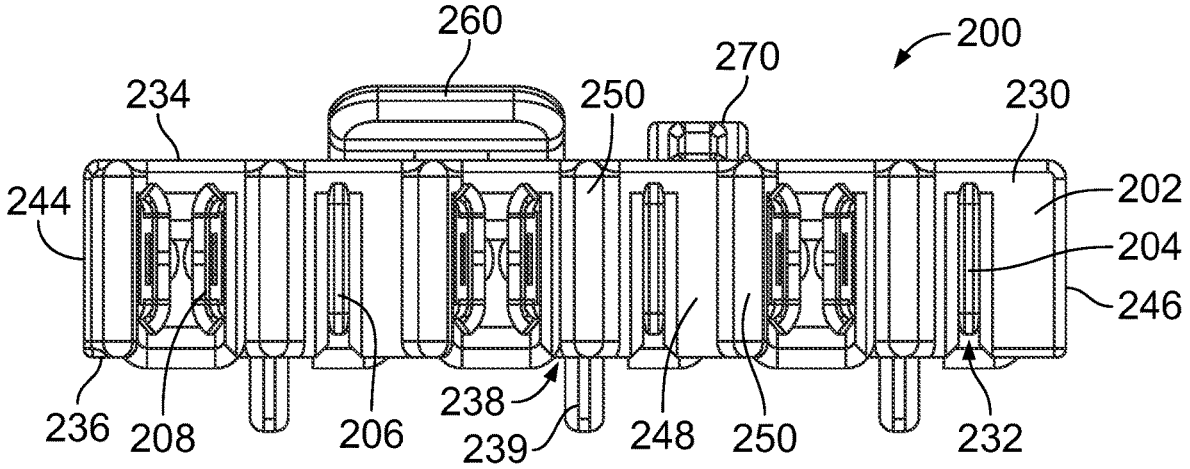
FIG. 4 is a front view of the electrical connector in accordance with an exemplary embodiment.
Figure 5:
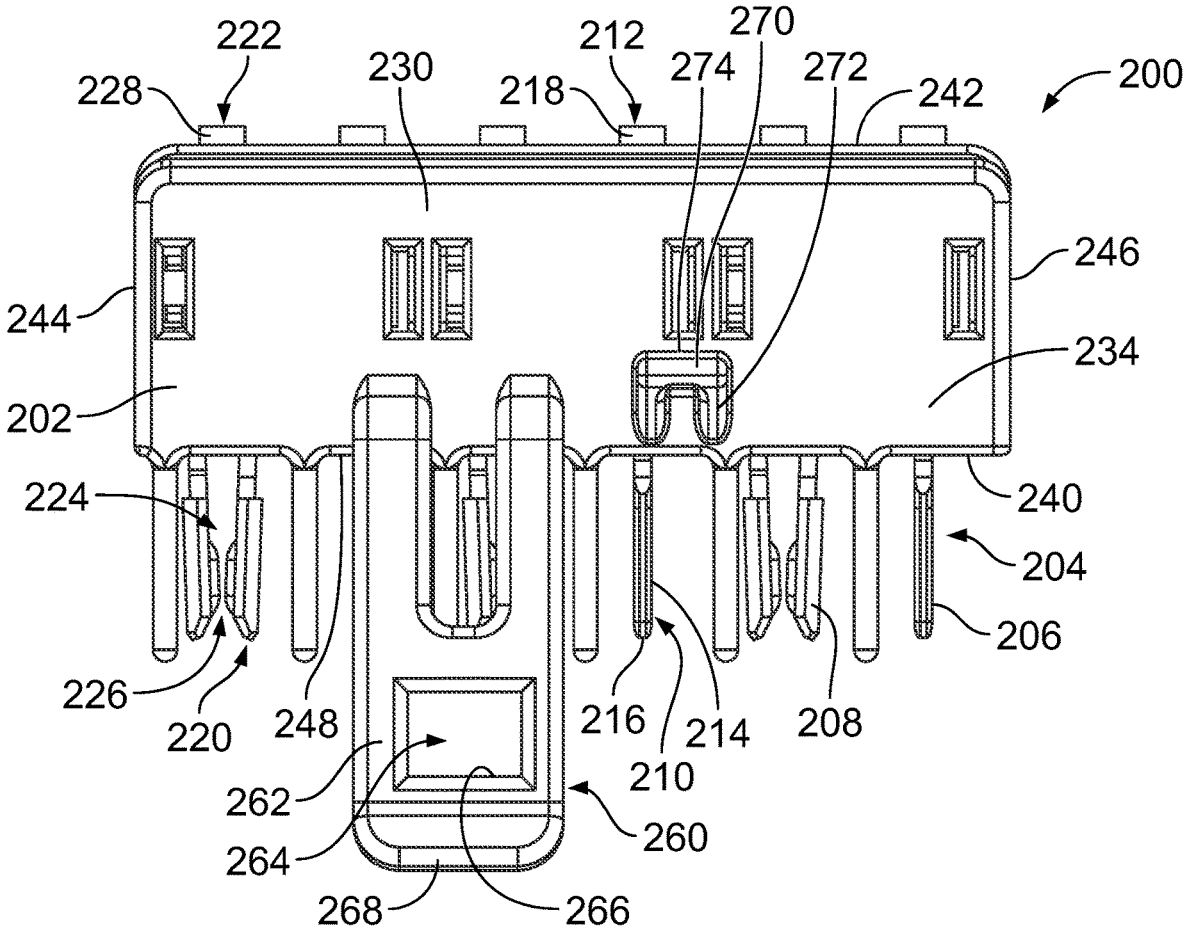
FIG. 5 is a top view of the electrical connector in accordance with an exemplary embodiment.
Figure 6:
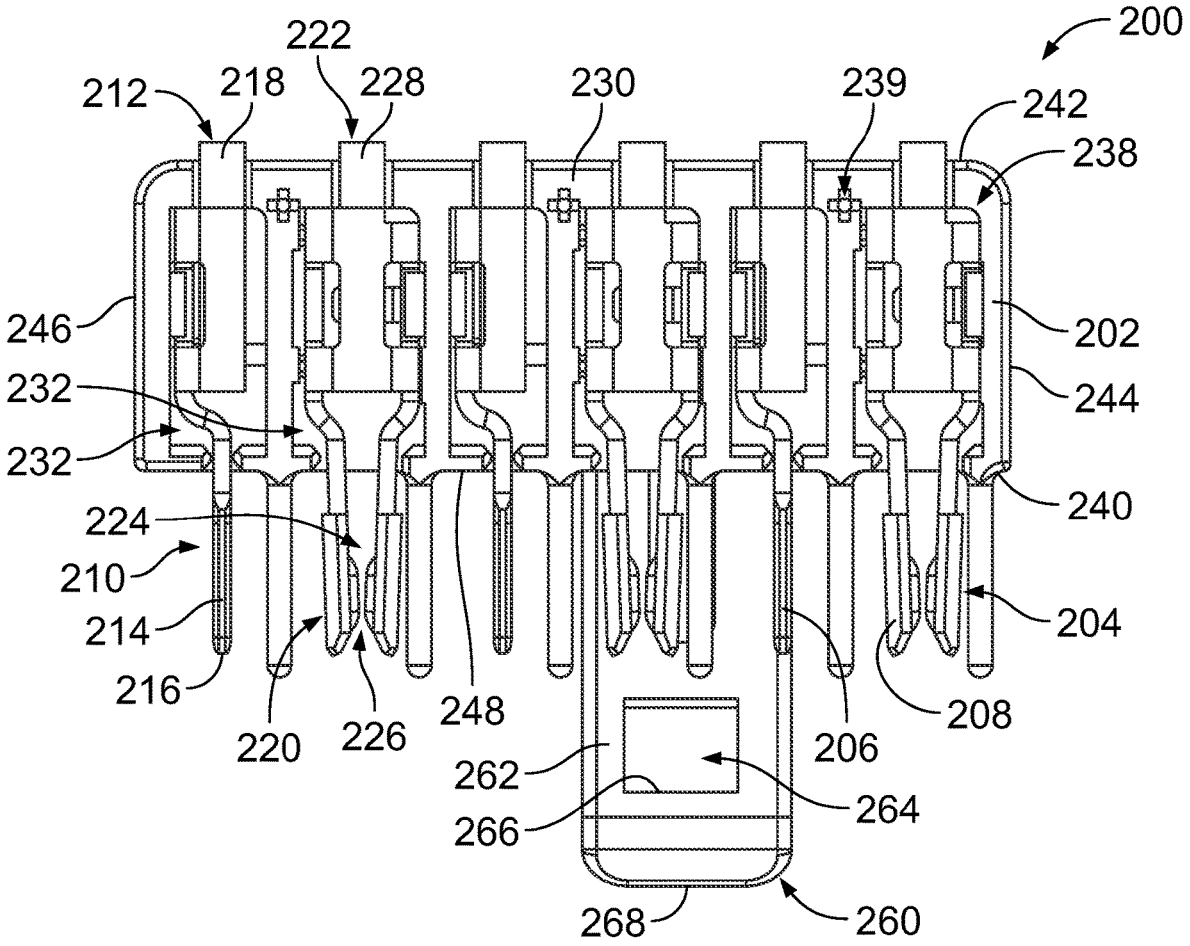
FIG. 6 is a bottom view of the electrical connector in accordance with an exemplary embodiment.
Figure 7:
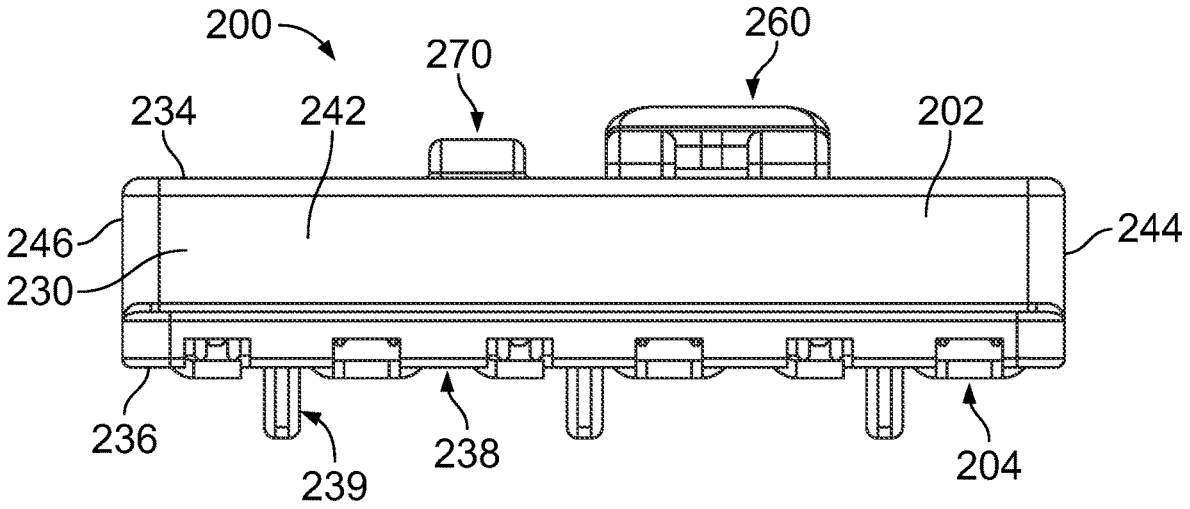
FIG. 7 is a rear view of the electrical connector in accordance with an exemplary embodiment.
Figure 8:
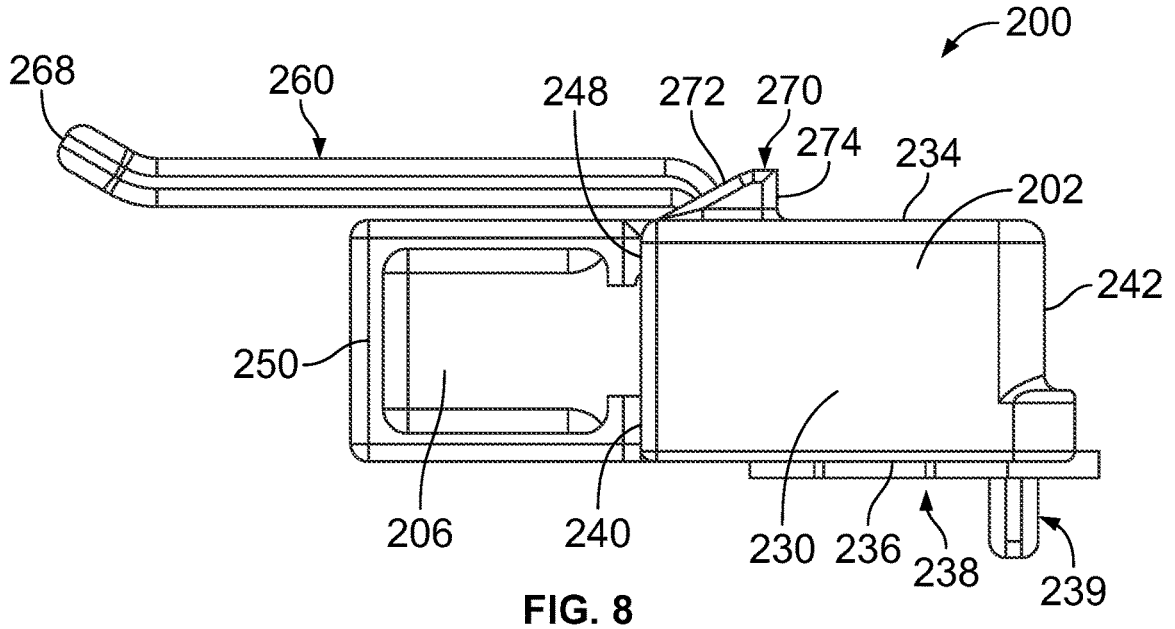
FIG. 8 is a side view of the electrical connector in accordance with an exemplary embodiment.

FIG. 3 is a top perspective view of the electrical connector 200 in accordance with an exemplary embodiment. FIG. 4 is a front view of the electrical connector 200 in accordance with an exemplary embodiment. FIG. 5 is a top view of the electrical connector 200 in accordance with an exemplary embodiment. FIG. 6 is a bottom view of the electrical connector 200 in accordance with an exemplary embodiment. FIG. 7 is a rear view of the electrical connector 200 in accordance with an exemplary embodiment. FIG. 8 is a side view of the electrical connector 200 in accordance with an exemplary embodiment. The electrical connector 200 includes the connector housing 202 and the contacts 204.

In an exemplary embodiment, the electrical connector 200 includes a plurality of the contacts 204. The contacts 204 are arranged in the connector housing 202 in a row. The contacts 204 may be stamped and formed contacts in various embodiments. In an exemplary embodiment, the contacts 204 include different types of contacts. For example, in the illustrated embodiment, the contacts 204 include plug contacts 206 and receptacle contacts 208. The plug contacts 206 are configured to be plugged into the receptacle contacts 208 of the mating electrical connector. For example, the plug contacts 206 may be blade contacts, tab contacts, or pin contacts and the receptacle contacts 208 may be socket contacts. The plug contacts 206 and the receptacle contacts 208 are arranged in the connector housing 202 to form a hermaphroditic mating interface. The hermaphroditic mating interface includes both male and female mating elements in a single electrical connector. The electrical connectors 200 have complementary paired identical parts, such as the plug contacts 206 and the receptacle contacts 208 forming the complementary mating interface.

Each plug contact 206 extends between a mating end 210 and a terminating end 212. The terminating end 212 is configured to be terminated to the LED board 110. The mating end 210 is configured to be mated with the corresponding receptacle contact of the mating electrical connector. In the illustrated embodiment, the mating end 210 includes a blade or tab 214 configured to be plugged into the receptacle contact 208 of the mating electrical connector. The tab 214 extends along a longitudinal axis to a distal end 216. The longitudinal axis is oriented horizontally in the illustrated embodiment. The tab 214 extends parallel to the other tabs 214. The distal ends 216 of the each of the tabs 214 may be aligned with each other. In an exemplary embodiment, the tab 214 includes top and bottom edges that extend to the distal end 216. Other types of mating ends may be provided in alternative embodiments, such as pins, sockets, spring beams, and the like for mating with the receptacle contact 208. In the illustrated embodiment, the terminating end 212 includes a tail 218. The tail 218 may be a solder tail configured to be soldered to the contact pad 122 of the LED board 110. In the illustrated embodiment, the solder tail is bent or oriented horizontally to extend along the upper surface of the LED board 110. In alternative embodiments, the tail 218 may be oriented vertically and configured to be plugged into a via in the LED board 110. In various embodiments, the terminating end 212 may include a compliant pin, such as an eye of the needle pin configured to be press-fit into a plated via of the LED board 110.

Each receptacle contact 208 extends between a mating end 220 and a terminating end 222. The terminating end 222 is configured to be terminated to the LED board 110. The mating end 220 is configured to be mated with a plug contact of the mating electrical connector. In the illustrated embodiment, the mating end 220 includes a socket 224 configured to receive the blade or tab of the mating electrical connector. The socket 224 extends along a longitudinal axis and has an opening 226 at a distal end to receive the tab. The distal ends of each of the sockets 224 may be aligned with each other. Other types of mating ends may be provided in alternative embodiments, such as pins, tabs, spring beams, and the like for mating with the corresponding contact of the mating electrical connector. In the illustrated embodiment, the terminating end 222 includes a tail 228. The tail 228 may be a solder tail configured to be soldered to the contact pad 122 of the LED board 110. In the illustrated embodiment, the solder tail is bent or oriented horizontally to extend along the upper surface of the LED board 110. In alternative embodiments, the tail 228 may be oriented vertically and configured to be plugged into a via in the LED board 110. In various embodiments, the terminating end 222 may include a compliant pin, such as an eye of the needle pin configured to be press-fit into a plated via of the LED board 110.

The connector housing 202 includes a main body 230 holding the contacts 204. The main body 230 is manufactured from a dielectric material, such as plastic. The main body 230 may be a molded part. In an exemplary embodiment, the connector housing 202 includes contact channels 232 extending through the main body 230. Each contact channel 232 holds the corresponding contact 204. The connector housing 202 extends between a top 234 and a bottom 236. The connector housing 202 extends between a front 240 and a rear 242. The connector housing 202 extends between a first side 244 and a second side 246.

In an exemplary embodiment, the main body 230 includes an end wall 248 at the front 240 extending between the first and second sides 244, 246. The contact channels 232 pass through the end wall 248. The contact channels 232 are spaced apart between the first and second sides 244, 246. The contact channels 232 extend between the front 240 and the rear 242 of the main body 230. In various embodiments, the contacts 204 may be loaded into the contact channels 232 through the bottom 236. The terminating ends 212, 222 of the plug and receptacle contacts 206, 208 extend from the main body 230 for termination to the LED board 110, such as extending rearward from the rear 242. The mating ends 210, 220 of the plug and receptacle contacts 206, 208 extend forward from the end wall 248.

The connector housing 202 includes a mounting base 238 at the bottom 236 configured to be mounted to the LED board 110. In an exemplary embodiment, the connector housing 202 includes mounting pins 239 extending from the mounting base 238 at the bottom 236. The mounting pins 239 are configured to be press-fit into openings in the LED board 110 to mount the connector housing 202 to the LED board 110. For example, the mounting pins 239 may include crush ribs extending along the sides of the mounting pins 239. Other types of mounting features may be provided in alternative embodiments, such as latches, clips, solder tabs, and the like to secure the connector housing 202 to the LED board 110.

In an exemplary embodiment, the connector housing 202 includes separating walls 250 extending forward from the end wall 248. The separating walls 250 separate the contacts 204 from each other, such as to prevent short circuiting, arcing, and the like. Optionally, distal ends of the separating walls 250 may extend beyond the distal ends of the contacts 204. The separating walls 250 may include guide features, such as lead in surfaces to guide mating with the mating electrical connector. The separating walls 250 may prevent damage to the contacts 204, such as from inadvertent touching or bending during shipping, handling, assembly, mating, and the like. In various embodiments, the connector housing 202 may include cover walls (not shown) extending along the top and/or bottom of the mating ends of the contacts 204.

In an exemplary embodiment, the connector housing 202 includes a latch 260 and a catch 270 used to latchably couple the electrical connector 200 to the mating electrical connector. The latch 260 and the catch 270 are offset from the centerline of the connector housing 202 (centered between the first side 244 and the second side 246). The latch 260 is offset toward the first side 244 and the catch 270 is offset toward the second side 246. In the illustrated embodiment, the latch 260 and the catch 270 are provided at the top 234. The catch 270 includes a ramp 272 at the front of the catch 270 and a catch surface 274 at the rear of the catch 270. The catch 270 is configured to interface with a latch of the mating electrical connector to secure the electrical connector 200 to the mating electrical connector.

The latch 260 extends forward from the end wall 248. The latch 260 includes a deflectable latch arm 262 having a latch opening 264 and a latching beam 266 along the latch opening 264. The latch opening 264 is configured to receive a catch of the mating electrical connector. The latch beam 266 is configured to interface with the catch of the mating electrical connector to secure the latch 260 to the catch. In an exemplary embodiment, the latch 260 includes a release tab 268 at the distal end of the latch arm 262. The release tab 268 is used to release the latch 260 from the mating electrical connector. Other locations are possible in alternative embodiments. Other types of securing features may be used in alternative embodiments to secure the electrical connector 200 to the mating electrical connector.

Figure 9:
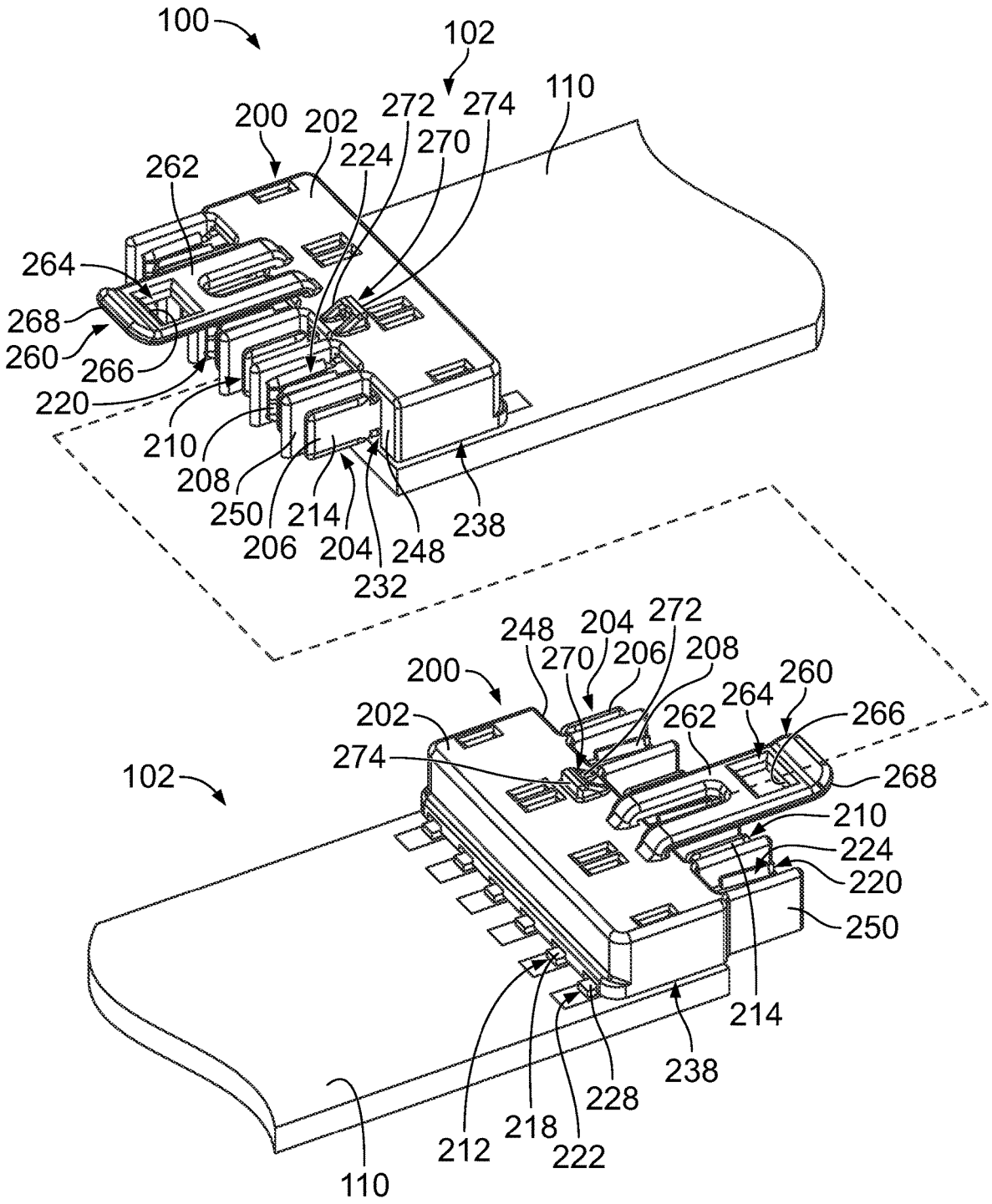
FIG. 9 illustrates a portion of the lighting system showing two of the LED assemblies poised for mating to each other in accordance with an exemplary embodiment.

FIG. 9 illustrates a portion of the lighting system 100 showing two of the LED assemblies 102 poised for mating to each other. When mated, the LED boards 110 of the LED assemblies 102 are arranged end to end in a strip. The LED boards 110 are electrically connected by the electrical connectors 200. Power is jumped across the thresholds between the LED boards 110 through the electrical connectors 200.

The electrical connectors 200 are provided at the ends of the LED boards 110. The electrical connectors 200 are aligned and face each other. In an exemplary embodiment, the electrical connectors 200 are identical to each other. The electrical connectors 200 have complementary, hermaphroditic mating interfaces to nest with each other (for example, both pluggable into each other). For example, the plug contacts 206 mate with the corresponding receptacle contacts 208 of the other electrical connector. The latches 260 are configured to latchably coupled to the corresponding catches 270 of the other electrical connector.

During assembly, the electrical connectors 200 are mounted to the corresponding LED boards 110. The mounting base 238 of the connector housing 202 is configured to be mounted to the LED board 110. The mounting pins 239 (FIG. 4) extend from the mounting base 238 for connection to the LED board 110. The terminating ends 212, 222 (FIG. 6) of the plug and receptacle contacts 206, 208 extend from the mounting base 238 for termination to the LED board 110. Optionally, the bottom sides of the tails 218, 228 may be co-planer with the mounting base 238 for termination to the LED board 110.

The contacts 204 are received in the contact channels 232 and pass through the end wall 248. The mating ends 210, 220 of the plug and receptacle contacts 206, 208 extend forward from the respective end wall 248 and are configured to be mated with the contacts of the other electrical connector. The tabs 214 are plugged into the sockets 224 during mating. When mated, the separating walls 250 are located between the mated pairs of contacts 204. The separating walls 250 may guide mating of the contacts 204 by positioning the electrical connectors 200 relative to each other during mating.

The electrical connector 200 is mounted to the LED board 110 at the end of the LED board 110. In an exemplary embodiment, a portion of the electrical connector 200 extends beyond the end of the LED board 110 for mating with the other electrical connector. For example, the end wall 248 may be generally aligned with the edge of the LED board 110. However, the mating ends 210, 220 and the separating walls 250 extend from the end wall 248 to mated with the other electrical connector. The mating ends 210, 220 and the separating walls 250 extend across the threshold to mate with the mating electrical connector.

During mating, the latches 260 are coupled to the catches 270. The distal end of the latch arm 262 rides along the ramp 272 to position the catch 270 in the latch opening 264. The latching beam 266 interfaces with the catch surface 274 to securely couple the latch 260 to the catch 270. The latch 260 may be released by lifting the release tab 268 upward to separate the electrical connector 200 from the mating electrical connector.

It is understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An LED assembly comprising:

an LED board extending between a first end and a second end, the LED board having an LED element on the LED board, the LED board including contact pads;

electrical connectors mounted to the LED board at the first and second ends, each electrical connector comprising:

a connector housing having a bottom mounted to the LED board and a top opposite the bottom, the connector housing having a front and a rear opposite the front, the connector housing having a first side and a second side, the connector housing having a plurality of contact channels arranged between the first side and the second side;

plug contacts arranged in corresponding contact channels, the plug contacts having male mating ends and plug terminating ends terminated to the corresponding mating pads of the LED board, the male mating ends configured to be plugged into female mating ends of receptacle contacts of a mating LED assembly;

receptacle contacts arranged in corresponding contact channels, the receptacle contacts having female mating ends and receptacle terminating ends terminated to the corresponding mating pads of the LED board, the female mating ends configured to receive male mating ends of plug contacts of the mating LED assembly;

wherein the plug contacts and the receptacle contacts are arranged in the connector housing to form a hermaphroditic mating interface.

2. The LED assembly of claim 1, wherein the electrical connectors include a first electrical connector at the first end of the LED board and a second electrical connector at the second end of the LED board, the first and second electrical connectors being identical to each other and facing in opposite directions.

3. The LED assembly of claim 1, wherein the plug contacts and the receptacle contacts are arranged in an alternating sequence.

4. The LED assembly of claim 1, wherein the plug contacts and the receptacle contacts are arranged in a single row.

5. The LED assembly of claim 1, wherein the male mating ends include tabs having mating interfaces at opposite sides of the tabs, the female mating ends including sockets.

6. The LED assembly of claim 1, wherein the connector housing includes separating walls arranged between the plug contacts and the receptacle contacts.

7. The LED assembly of claim 1, wherein the connector housing includes a latch configured to be latchably coupled to the mating LED assembly.

8. The LED assembly of claim 1, wherein the connector housing includes a latch extending forward of the front of the connector housing, the latch being offset from a center line of the connector housing toward the first side, the connector housing including a catch offset from the center line of the connector housing toward the second side, the latch being configured to be coupled to a catch of the mating LED assembly, the catch being configured to be coupled to a latch of the mating LED assembly.

9. A lighting system comprising:

a plurality of LED assemblies electrically connected in series, each LED assembly comprising:

an LED board extending between a first end and a second end, the LED board having an LED element on the LED board, the LED board including contact pads;

electrical connectors mounted to the LED board at the first and second ends, each electrical connector comprising:

a connector housing having a bottom mounted to the LED board and a top opposite the bottom, the connector housing having a front and a rear opposite the front, the connector housing having a first side and a second side, the connector housing having a plurality of contact channels arranged between the first side and the second side;

plug contacts arranged in corresponding contact channels, the plug contacts having a male mating end and a plug terminating end, the plug terminating end being terminated to the corresponding mating pad of the LED board;

receptacle contacts arranged in corresponding contact channels, the receptacle contacts having a female mating end and a receptacle terminating end, the receptacle terminating end being terminated to the corresponding mating pad of the LED board;

wherein the plug contacts and the receptacle contacts are arranged in the connector housing to form a hermaphroditic mating interface; and wherein adjacent LED assemblies are electrically connected by plugging the male mating ends of the plug contacts into the female mating ends of the receptacle contacts of the corresponding electrical connectors.

10. The lighting system of claim 9, wherein the LED assemblies include a first LED assembly, a second LED assembly, and a third LED assembly, the electrical connector at the first end of the LED board of the second LED assembly being mated to one of the electrical connectors of the first LED assembly, the electrical connector at the second end of the LED board of the second LED assembly being mated to one of the electrical connectors of the third LED assembly.

11. The lighting system of claim 9, wherein all of the electrical connectors are identical to each other.

12. The lighting system of claim 9, wherein the plug contacts and the receptacle contacts are arranged in an alternating sequence.

13. The lighting system of claim 9, wherein the male mating ends and the female mating ends extend beyond the LED board to span across thresholds between the LED boards to electrically connect the adjacent LED assemblies.

14. The lighting system of claim 9, wherein the connector housing includes a latch extending forward of the front of the connector housing, the latch being offset from a center line of the connector housing toward the first side, the connector housing including a catch offset from the center line of the connector housing toward the second side, wherein adjacent LED assemblies are mechanically coupled together by mating the latches to the corresponding catches of the adjacent LED assemblies.

15. A lighting system comprising:

a first LED assembly and a second LED assembly connected in series;

the first LED assembly including a first LED board having a first LED element on the first LED board and a first electrical connector mounted to the first LED board at an end of the first LED board, the first electrical connector including a first connector housing having a bottom mounted to the first LED board and a top opposite the bottom, the first connector housing having a front and a rear opposite the front, the first connector housing having opposite sides, the first connector housing having first contact channels arranged between the sides, the first electrical connector including first plug contacts arranged in corresponding first contact channels, the first plug contacts having male mating ends and plug terminating ends terminated to the first LED board, the first electrical connector including first receptacle contacts arranged in corresponding first contact channels, the first receptacle contacts having female mating ends and receptacle terminating ends terminated to the first LED board; and the second LED assembly including a second LED board having a second LED element on the second LED board and a second electrical connector mounted to the second LED board at an end of the second LED board, the second electrical connector including a second connector housing having a bottom mounted to the second LED board and a top opposite the bottom, the second connector housing having a front and a rear opposite the front, the second connector housing having opposite sides, the second connector housing having second contact channels arranged between the sides, the second electrical connector including second plug contacts arranged in corresponding second contact channels, the second plug contacts having male mating ends and plug terminating ends terminated to the second LED board, the second electrical connector including second receptacle contacts arranged in corresponding second contact channels, the second receptacle contacts having female mating ends and receptacle terminating ends terminated to the second LED board wherein the first electrical connector is mated to the second electrical connector to electrically connect the first LED board to the second LED board, the first plug contacts being plugged into the second receptacle contacts, the second plug contacts being plugged into the first receptacle contacts.

16. The lighting system of claim 15, wherein the first electrical connector is identical to the second electrical connector.

17. The lighting system of claim 15, wherein the first plug contacts and the first receptacle contacts are arranged in the first connector housing to form a first hermaphroditic mating interface and wherein the second plug contacts and the second receptacle contacts are arranged in the second connector housing to form a second hermaphroditic mating interface configured to be mated with the first hermaphroditic mating interface.

18. The lighting system of claim 15, wherein the first plug contacts and the first receptacle contacts are arranged in an alternating sequence, and wherein the second plug contacts and the second receptacle contacts are arranged in an alternating sequence.

19. The lighting system of claim 15, wherein the first plug contacts include first tabs and the first receptacle contacts include first sockets and wherein the second plug contacts include second tabs and the second receptacle contacts include second sockets, the first tabs being plugged into the second sockets, the second tabs being plugged into the first sockets.

20. The lighting system of claim 15, wherein the first connector housing includes a first latch extending forward of the front of the first connector housing offset from a center line of the first connector housing, the first connector housing including a first catch offset from the center line of the first connector housing, the second connector housing includes a second latch extending forward of the front of the second connector housing offset from a center line of the second connector housing, the second connector housing including a second catch offset from the center line of the second connector housing, the first latch coupled to the second catch to secure the first electrical connector to the second electrical connector, the first catch being coupled to the second latch to secure the first electrical connector to the second electrical connector.

* * * * *